US008251483B2

(12) United States Patent
Menzel et al.

(10) Patent No.: US 8,251,483 B2
(45) Date of Patent: Aug. 28, 2012

(54) MITIGATION OF SHORTED FLUID EJECTOR UNITS

(75) Inventors: Christoph Menzel, New London, NH (US); Paul A. Hoisington, Hanover, NH (US)

(73) Assignee: FUJIFILM Corporation, Tokyo (JP)

( * ) Notice: Subject to any disclaimer, the term of this patent is extended or adjusted under 35 U.S.C. 154(b) by 713 days.

(21) Appl. No.: 12/371,471

(22) Filed: Feb. 13, 2009

(65) Prior Publication Data

US 2010/0207974 A1 Aug. 19, 2010

(51) Int. Cl.
*B41J 29/393* (2006.01)

(52) U.S. Cl. ..... 347/19; 310/324

(58) Field of Classification Search ..... 347/19; 310/324

See application file for complete search history.

(56) References Cited

U.S. PATENT DOCUMENTS

| | | | | |
|---|---|---|---|---|
| 6,141,093 | A * | 10/2000 | Argyle et al. | 356/237.1 |
| 6,554,407 | B1 | 4/2003 | Ikeda et al. | |
| 6,801,438 | B1 * | 10/2004 | Castro | 361/765 |
| 6,929,352 | B2 * | 8/2005 | Silverbrook | 347/65 |
| 7,387,361 | B1 * | 6/2008 | Rueby et al. | 347/41 |
| 7,589,455 | B2 * | 9/2009 | Adachi et al. | 310/335 |
| 2004/0012653 | A1 * | 1/2004 | Trueba et al. | 347/63 |
| 2004/0135253 | A1 * | 7/2004 | Schoenfeld et al. | 257/738 |
| 2004/0227789 | A1 * | 11/2004 | Silverbrook | 347/54 |
| 2008/0067895 | A1 * | 3/2008 | Adachi et al. | 310/324 |

FOREIGN PATENT DOCUMENTS

| | | | |
|---|---|---|---|
| KR | 2006077937 | A * | 7/2006 |
| WO | 2009142908 | | 11/2009 |

* cited by examiner

*Primary Examiner* — Charlie Peng
*Assistant Examiner* — Peter Radkowski
(74) *Attorney, Agent, or Firm* — Fish & Richardson P.C.

(57) ABSTRACT

A fluid ejector includes a plurality of fluid ejector units, each fluid ejector unit characterized in part by a pumping actuator that includes an electrode. Whether one or more of the plurality of fluid ejector units is a shorted fluid ejector unit is determined, and the shorted fluid ejector unit is trimmed.

12 Claims, 8 Drawing Sheets

MITIGATION OF SHORTED FLUID EJECTOR UNITS

TECHNICAL FIELD

The following description relates to mitigation of electrical shorts in a fluid ejection module.

BACKGROUND

A fluid ejection module, for example, as employed in an ink jet printer, typically includes a fluid path from a fluid supply to a fluid nozzle assembly that includes nozzles from which fluid (ink) drops are ejected. Fluid drop ejection can be controlled by pressurizing fluid in the fluid path with a pumping actuator, for example, a piezoelectric deflector. Although many configurations are possible, a typical fluid ejector or printhead module has a line or an array of fluid ejector units with a corresponding array nozzles, ink paths, and associated actuators, and drop ejection from each nozzle can be independently controlled. The printhead module and the medium can be moving relative one another during a printing operation. In a so-called "drop-on-demand" printhead module, each actuator is fired to selectively eject a drop at a specific location on a medium.

In one example, a fluid ejection module can include a semiconductor printhead body and a piezoelectric pumping actuator. The printhead body can be made of silicon etched to define pumping chambers. Nozzles can be defined by a separate substrate (i.e., a nozzle layer) that is attached to the printhead body. The piezoelectric actuator can have a layer of piezoelectric material that changes geometry, or flexes, in response to an applied voltage. Flexing of the piezoelectric layer causes a membrane to flex, where the membrane forms a wall of the pumping chamber. Flexing the membrane thereby pressurizes ink in a pumping chamber located along the ink path and ejects an ink drop from a nozzle at a nozzle velocity. Aspects of the construction and operation of fluid ejection modules known to the art can be found, for example, in U.S. Patent Pub. No. 2005/0099467, entitled "Print Head with Thin Membrane" filed by Bibl et al on Oct. 8, 2004 and published May 12, 2005, the entire contents of which is hereby incorporated by reference. U.S. Patent Pub. No. 2005/0099467 describes examples of printhead modules and fabrication techniques.

SUMMARY

In the manufacture of a fluid ejection module, particularly in the manufacture of a die including an array of fluid ejector units, it is possible to form an electrical "short" in an electrode for a pumping actuator of a particular fluid ejector unit. Such fluid ejector units may be termed "shorted fluid ejector units." Common electronic configurations, e.g., driving circuitry, employed for the activation of individual jets in fluid ejection modules can be compromised or damaged by such a shorted fluid ejector unit. Accordingly, there is a need to mitigate the effect of shorted fluid ejector units such as those employed in piezoelectric printheads.

A portion of the conductive layer in which the short occurs is to be severed from the remainder of the conductive layer, thus isolating the short from either the remainder of the fluid ejector unit or the driving circuitry, and thus either repairing or disabling the fluid ejector unit.

In one aspect, a method includes determining that one or more of a plurality of fluid ejector units of a fluid ejector is an electrically shorted fluid ejector unit, and trimming the shorted fluid ejector unit. Each fluid ejector unit is characterized in part by actuator having an electrode.

Implementations can include one or more of the following. The shorted fluid ejector unit may be determined by a capacitance measurement, optical microscopy, thermal imaging during electrical stimulation of the shorted fluid ejector unit, electron microscopy, or laser scanning Trimming may electrically isolate the shorted fluid ejector unit, thereby disabling the shorted fluid ejector unit. Trimming the shorted fluid ejector unit may cut a connection between the shorted fluid ejector unit and a bond pad at an electrical drive feed of the fluid ejector, thereby disabling the shorted fluid ejector unit. Trimming the shorted fluid ejector unit may remove a corresponding bond pad at an electrical drive feed of the fluid ejector, thereby disabling the shorted fluid ejector unit. A location or identity of the shorted fluid ejector unit may be recorded, and control of the fluid ejector may be adapted to account for the shorted fluid ejector unit. A location of a short in the shorted fluid ejector unit may be determined, e.g., by optical microscopy, or by thermal imaging during electrical stimulation of the shorted fluid ejector unit. Trimming may remove the short and may restore the shorted fluid ejector unit to function. The shorted fluid ejector unit may be characterized by a plurality of electrodes that include a shorted electrode and a non-shorted electrode, and the trimming may cut the shorted electrode but not the non-shorted electrode, and the shorted fluid ejector unit may be at least partially restored to function. Trimming may be performed by a laser, an etch process, by an ion beam, or by mechanical cutting. The pumping actuator may be a piezoelectric deflector, a thermal bubble jet generator, or an electrostatically deflected element.

In another aspect, a fluid ejector includes a plurality of fluid ejector units, each fluid ejector unit characterized in part by an electrode that contacts a pumping element. One or more of the plurality of fluid ejector units is an otherwise shorted fluid ejector unit that is disabled or is at least partially restored to function.

Implementations can include one or more of the following. The shorted fluid ejector unit may electrically isolated from the fluid ejector, thereby disabling the shorted fluid ejector unit. A connection may be cut between the shorted fluid ejector unit and a bond pad at an electrical drive feed of the fluid ejector, thereby disabling the shorted fluid ejector unit. A bond pad at an electrical drive feed of the fluid ejector may be removed, the bond pad corresponding to the shorted fluid ejector unit, thereby disabling the shorted fluid ejector unit. An electronically readable memory may records a location or identity of the shorted fluid ejector unit, and control of the fluid ejector may be adapted to account for the shorted fluid ejector unit. A short in the shorted fluid ejector unit may be trimmed, and the shorted fluid ejector unit may be restored to function. The shorted fluid ejector unit may be characterized by a plurality of electrodes that include a non-shorted electrode and a cut, shorted electrode, and the shorted fluid ejector unit may be at least partially restored to function. An electronically readable memory may record a location or identity of the shorted fluid ejector unit and each cut electrode, and control of other fluid ejectors may be adapted to compensate for the loss of function in the shorted fluid ejector unit. The pumping actuator may be a piezoelectric deflector, a thermal bubble jet generator, or an electrostatically deflected element.

Advantages can include one or more of the following. Shorted fluid ejector units can be repaired or disabled. Printing defects from the resulting fluid ejection module can be reduced.

The details of one or more embodiments are set forth in the accompanying drawings and the description below. Other features and advantages will be apparent from the description and drawings, and from the claims.

DESCRIPTION OF DRAWINGS

FIGS. 2A-D depict short 133, another variety of short in addition to shorts 29, 31, and 33 of FIGS. 1E-H.

FIG. 2A shows that trimming can cut all shorted traces 140 between the actuators and the bond pads 137*a*, thereby disabling the shorted fluid ejector units.

FIG. 2B shows that trimming can also mean removing corresponding bond pads 137*a*, thereby disabling the shorted fluid ejector units.

FIG. 2C shows that short 133 itself can be trimmed, which may then restore the shorted fluid ejector units to partial or complete function.

FIG. 2D depicts one method of restoring one of the shorted fluid ejector units to at least partial function, by trimming one of the traces 140.

Like reference symbols in the various drawings indicate like elements.

DETAILED DESCRIPTION

Methods and apparatus are described for mitigating the effect of shorted fluid ejector units in a fluid ejection module. In brief, a portion of an electrode that creates the short can be trimmed, thus removing the short and restoring the shorted fluid ejector unit. Alternatively, if the fluid ejector unit cannot be repaired by trimming the electrode, the shorted fluid ejector unit can be disabled.

Figure 1A:
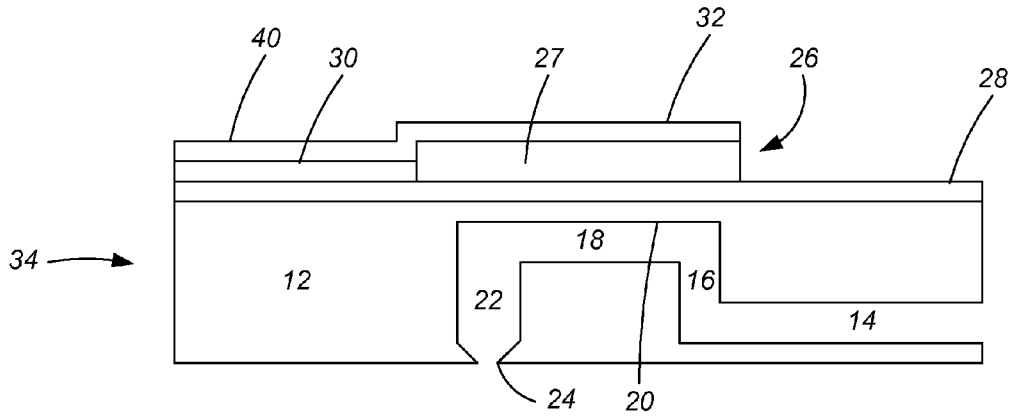
FIG. 1A is a side view of a die 34 of a fluid ejection module.

FIG. 1A is a side view of a fluid ejection module which includes a die 34 with a substrate 12 that functions in part as a flow-path body. Substrate 12 can have one or more fluid flow paths formed therein (only one flow path is shown in the cross-sectional view of FIG. 1A), and each flow path can include features such as a fluid inlet 14, an ascender 16, a pumping chamber 18 with a wall defined by a membrane 20, a descender 22, and a nozzle 24. The flow-path body/substrate 12, a membrane layer that provides the membrane 20, and a nozzle layer in which the nozzle 24 is formed, can each be silicon, e.g., single crystal silicon.

The die 34 of the fluid ejection module also includes one or more pumping actuators 26. The pumping actuator 26 can be a piezoelectric deflector, a thermal bubble jet generator, or an electrostatically deflected element. Typically, the pumping actuator is a piezoelectric deflector, whereby the fluid ejection module is a piezoelectric fluid ejection module. The actuator 26 is located over the membrane 20, and activation of the actuator 26 causes the membrane 20 to deflect into the pumping chamber 18, forcing fluid, e.g., ink, out of the nozzle 24. Thus, each flow path with its associated actuator provides an individually controllable MEMS fluid ejector unit.

Each piezoelectric actuator 26 includes a bottom electrode 28 (typically a ground electrode, which can be a common electrode across multiple actuators) adjacent the membrane 20, a top electrode 32 (typically a drive electrode), and a piezoelectric layer 27 sandwiched between the bottom electrode 28 and top electrode 32. A conductive trace 40, which can be formed from the same conductive layer as the top electrode 32 and/or a different conductive layer, permits drive signals to be applied to the drive electrode 32.

Figure 1B:
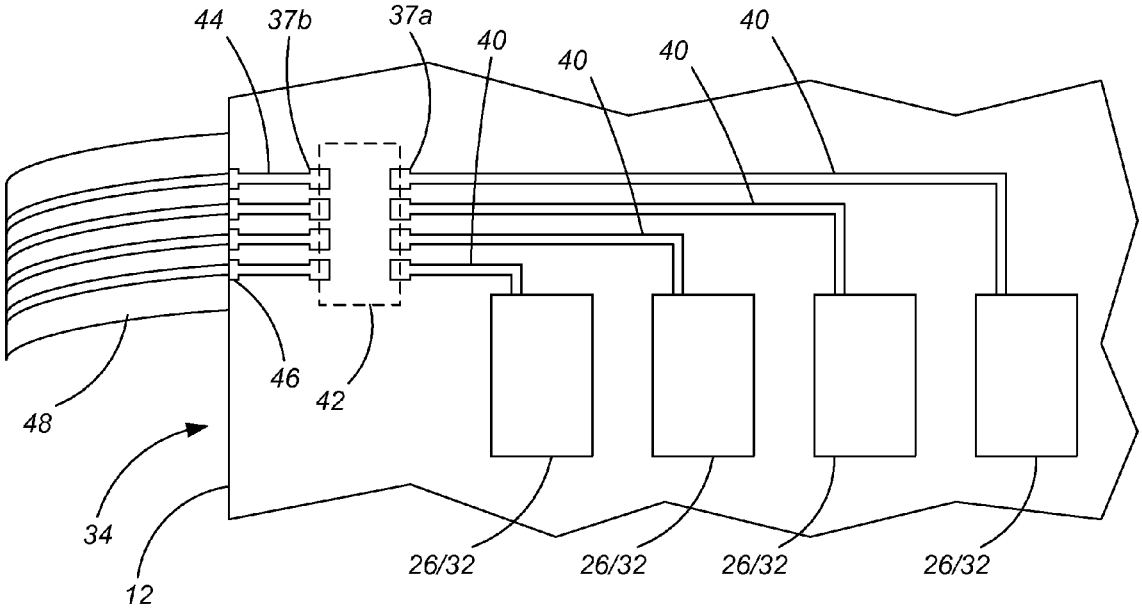
FIG. 1B shows a top or plan view of a die 34 of a fluid ejection module, in which the die includes multiple fluid ejector units.

FIG. 1B shows a top or plan view of the die 34 (which includes the substrate 12 and the actuators 26). The die 34 can fabricated using semiconductor processing techniques. One or more integrated circuit chips 42 (shown in phantom), e.g., application specific integrated circuits (ASICs), can be mounted and electrically connected to two sets of bond pads 37*a*, 37*b* on the die The traces 40 connect the drive electrodes 32 to the first set of bond pads 37*a*, and additional traces 44 connect the second set of bond pads 37*b* to electrical contacts 46 at the edge of the die 34. A flex circuit 48 can be coupled to the electrical contacts 46 Thus, data and control signals from an external processor can be directed through flex circuit 48 to the ASICs 42, which can then control the voltage applied through traces 40 to the drive electrodes 32.

Figure 1C:
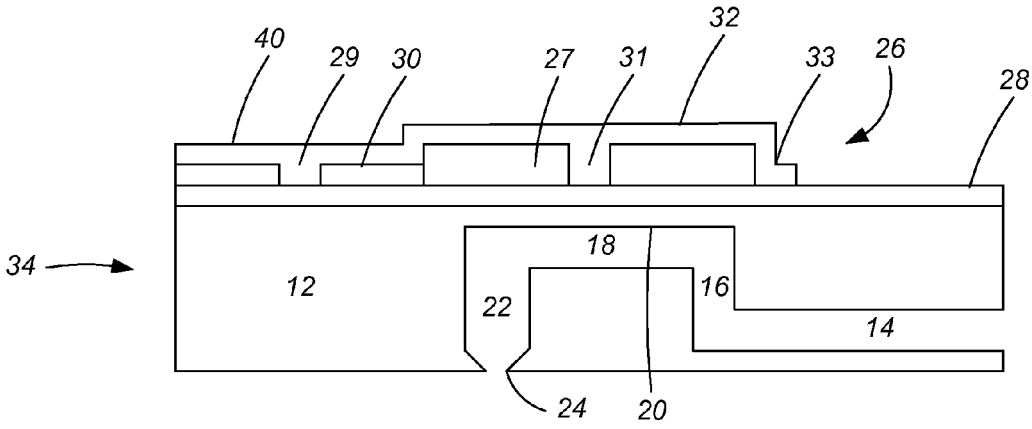
FIG. 1C is a side view of a shorted fluid ejector unit, adapted from FIG. 1A to show various shorting defects 29, 31, and 33.

FIG. 1C is a side view of shorted fluid ejector unit, adapted from FIG. 1A to show various shorting defects. As in FIG. 1A, actuator 26 includes an electrode 28 (typically a ground electrode), an insulating layer 30, and one or more electrodes 32 (typically drive electrodes), and one or more traces 40 to electrically connect the electrode 32 to a bond pad. A defect in the process of forming insulating layer 30 can leave a void in the insulating layer, so that when the conductive trace 40 is deposited, it extends through the void to contact the ground electrode 28 through short 29. Similarly, a defect in the process of forming the piezoelectric layer 27 can leave a void in the piezoelectric layer, so that when the drive electrode 32 is deposited, it extends through the void to contact the ground electrode 28 through short 31. Another defect can arise when a portion of the drive electrode 32 extends over the edge of the piezoelectric layer 27 to contact the ground electrode 28 through short 33. The driving circuitry, e.g., the ASIC 42 (see FIG. 1B), can be compromised or damaged by such shorts.

Figure 1D:
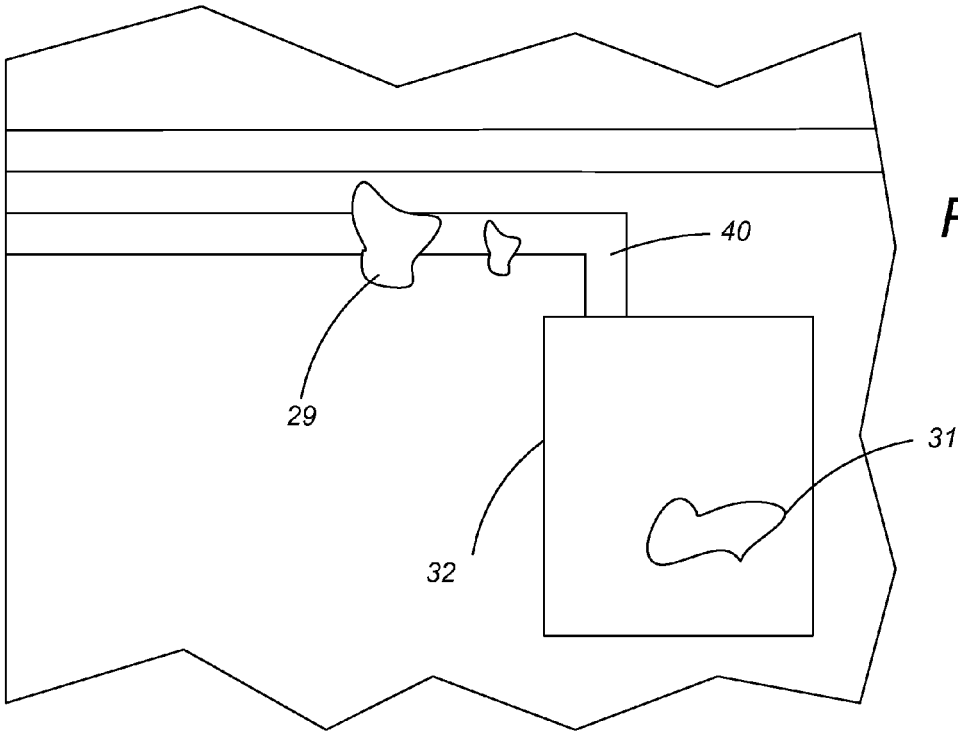
FIG. 1D is a plan or top view of the die 34 of the fluid ejection module, showing the defects 29, 31, and 33 illustrated in FIG. 1C.

FIG. 1D is a plan or top view of a die of a fluid ejection module, showing the defects exemplified in FIG. 1C. For ease of viewing, the dimensions of certain components are exaggerated. As in FIGS. 1A and 1C, actuator 26 includes an outer electrode 32 (typically a drive electrode), an insulating layer (not visible in FIG. 1D because it is beneath the outer electrode, see layer 30 in FIGS. 1A and 1C), and an underlying electrode (typically a ground electrode, not visible because in FIG. 1D because it is beneath the outer electrode). A defect in forming insulating layer 30 as in FIG. 1C can leave a void which allows electrode 32 to contact electrode 28 at short 29. Similarly, a defect in forming actuator layer 26 can leave a void which allows electrode 32 to contact electrode 28 at short 31. Another defect can arise when a portion of electrode 32 overlays actuator layer 26 to contact electrode 28 at short 33.

Such defects can arise from the manufacturing process, e.g., from incomplete deposition of insulating layers such as 30 or actuator layers such as 26, permitting overlaid electrode layers such as 32 to contact underlaying electrodes such as 28. Such defects can also arise from defects in lithography processes, e.g., by defects in patterning or removal of resist layers, by incomplete removal of layers not protected by resist, and the like.

The danger of such defects is that a single shorted fluid ejector unit can damage the driving circuitry, e.g., the ASIC 42, and potentially render the entire fluid ejection module unusable. However, by limiting the failure to isolated fluid ejector units, it is possible to compensate for non-functional fluid ejector units by applying extra ink with neighboring fluid ejector unit.

FIG. 1E-H are plan or top views of the die 34 showing various examples of trimming to correct one or more of the shorting defects 29, 31 and 33 exemplified in FIGS. 1C and 1D. As used herein, "trimming" means to cut or otherwise sever (e.g., by removal) one or more electrically conductive portions of a fluid ejector unit, typically drive electrodes and/or traces, but possibly other components. Trimming the electrode or trace can electrically isolate a shorting defect on a fluid ejector unit. Trimming can selectively electrically isolate an entire shorted fluid ejector unit, or a portion thereof, depending on the nature of the defect and the trimming process. Depending on the manner of trimming, a shorted fluid ejector unit may be totally disabled, or partially disabled so as to isolate the defect but leaving some function to the fluid ejection module. Also, depending on the defect, trimming can return the fluid ejector unit to full function.

Figure 1E:
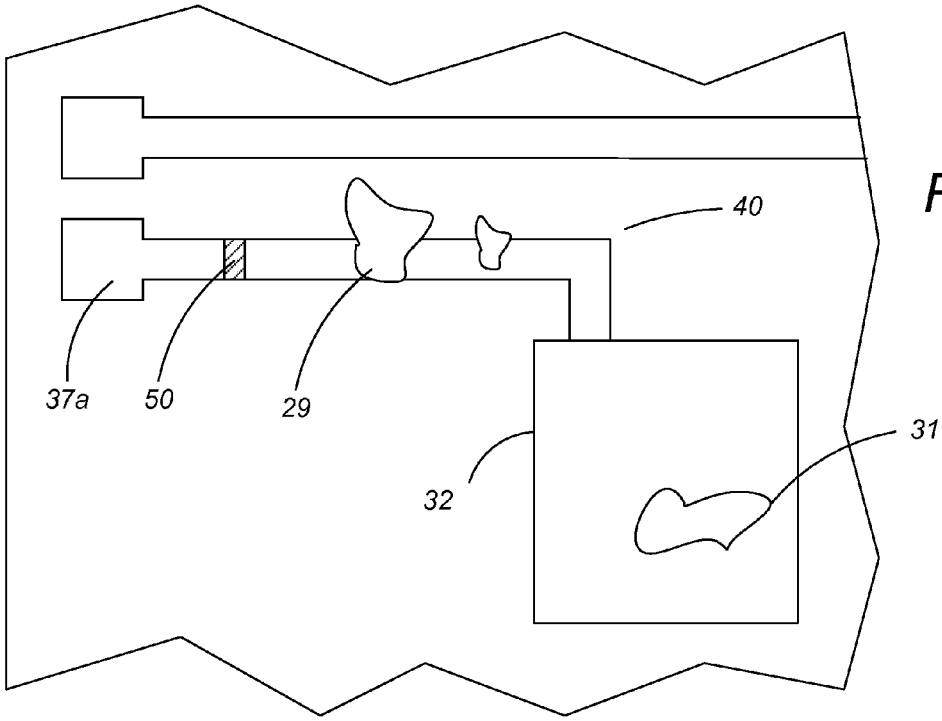
FIGS. 1E-H are plan or top views of the die from the fluid ejection module, showing various examples of trimming to correct one or more of the shorting defects 29, 31 and 33 exemplified in FIGS. 1C and 1D.

For example, in FIG. 1E, trimming (symbolized by the shaded area 50 indicating the region removed) is depicted as cutting entirely across the width of trace 40, thereby electrically isolating the entire electrode 32 from the driving circuitry, effectively disabling the shorted fluid ejector unit. This can be performed when the short extends entirely or substantially across the trace 40, or the short covers a large area of the drive electrode (e.g., sufficiently large that the actuator would not function properly if the shorted area is removed). The cut is closer to the ASIC than any short so that the short is isolated from the ASIC.

Figure 1F:
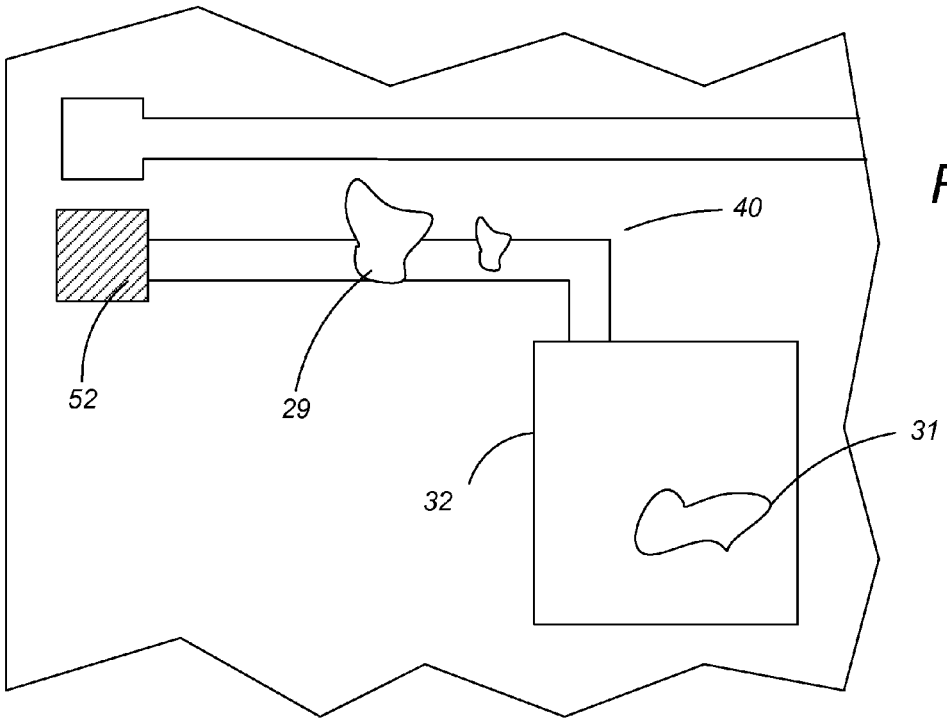

FIG. 1F shows that the shorted fluid ejector unit can also be trimmed by removing a corresponding bond pad 37*a* (symbolized by shaded box 52) so there is not electrical connection from the ASIC to the trace 40, thereby disabling the shorted fluid ejection module.

Figure 1G:
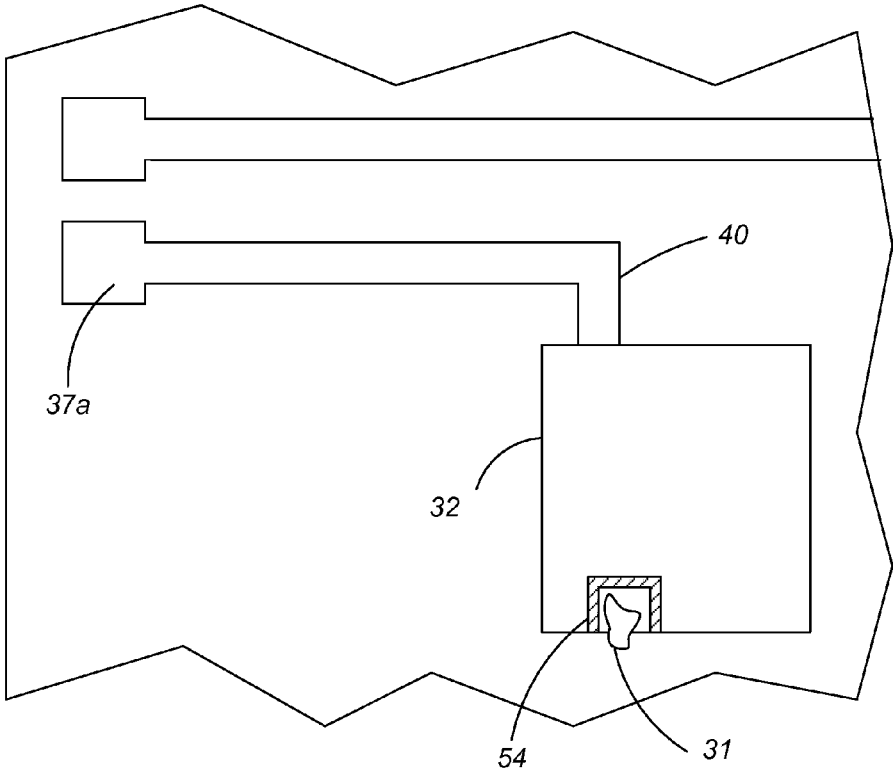

In various implementations, trimming can remove the short itself, whereby the shorted fluid ejection module can be restored to function, or at least partial function. FIG. 1G shows that short 33 in the drive electrode 32 itself can be trimmed while leaving substantially the rest of the drive electrode undisturbed, which may then restore shorted fluid ejector unit to partial or complete function. If the trace is sufficiently wide, it can be possible to similarly trim shorts in the trace 40 and restore the fluid ejector unit to partial or complete function.

In various implementations, trimming can isolate the short, whereby the shorted fluid ejector unit can be restored to at least partial function. This can be performed when the short covers a small area of the drive electrode (e.g., sufficiently small that the actuator will function properly if the shorted area is removed). The cut electrically isolates the short from the remainder of electrode 34 to which the drive signal will be applied.

Figure 1H:
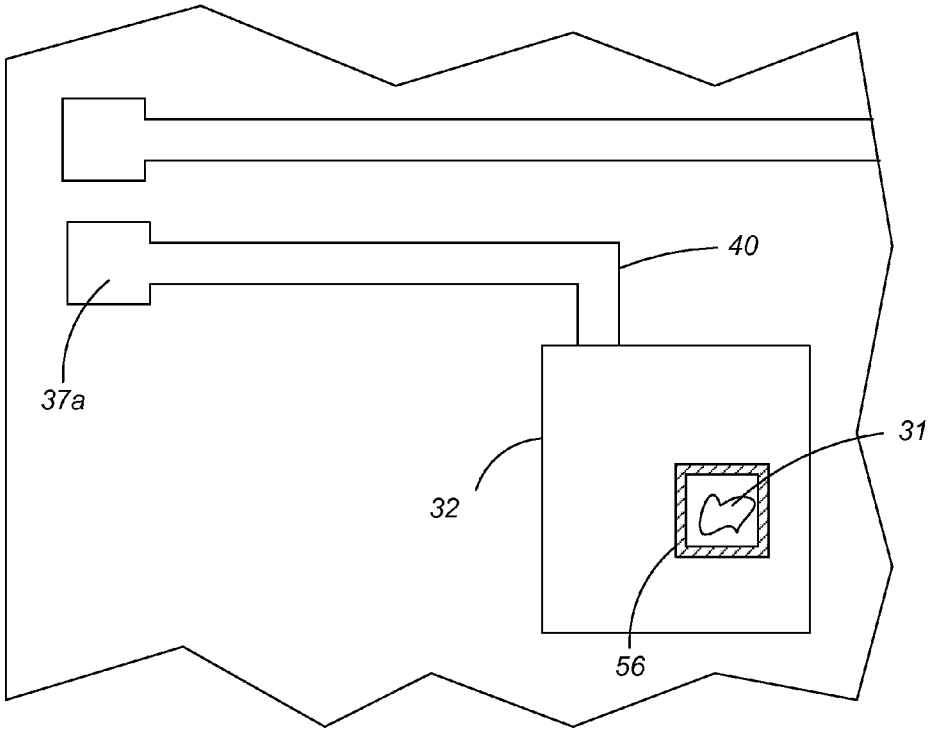

As depicted in FIG. 1H, the shorted fluid ejector unit can be trimmed to isolate shorts such as short 33, while still leaving a portion of electrode 32 and/or actuator 26 connected to trace 40, which can restore the shorted fluid ejector unit to at least partial function. The process of trimming can cut a rectangle or oval or other convenient shape around the defect. The cut can completely surround the short (symbolized in FIG. 1H by shaded region 56), or can extend to an edge of the electrode 32 (symbolized in FIG. 1G by shaded region 54).

Since some portion of the electrode 32 and actuator remain electrically connected to the ASIC, and the short is electrically isolated from the ASIC and remainder of the actuator 26, trimming in the manner of FIGS. 1G and 1H may restore at least partial function to fluid ejector unit.

Once modifications such as those shown in FIGS. 1E-H have been performed, the fluid ejector unit is, in terms of the claims, an otherwise shorted fluid ejection module that is disabled or is at least partially restored to function. That is, if not for modifications such as those shown in FIGS. 1E-G, the fluid ejector unit would be shorted by one or more shorts such as shorts 29, 31 and 33, but with the trimming modifications, the fluid ejector unit can be disabled or at least partially restored to function.

FIGS. 2A-D show plan views of a shorted fluid ejection module 100, which has a number of electrodes 132 coupled by corresponding traces 140 to corresponding bond pads 137*a* or electrical drive feed 126. FIGS. 2A-D depict an inter-trace short 133, another variety of short in addition to shorts 29, 31, and 33 of FIGS. 1E-H. The inter-trace short 133 is depicted between electrode traces 140. The inter-trace short 133 can be caused by improper metallization that connects the traces (e.g., a defect in a portion of the metal layer that forms the traces 40, rather than a hole through the piezoelectric or insulating layer which connects the drive electrode to the ground electrode).

Figure 2A:
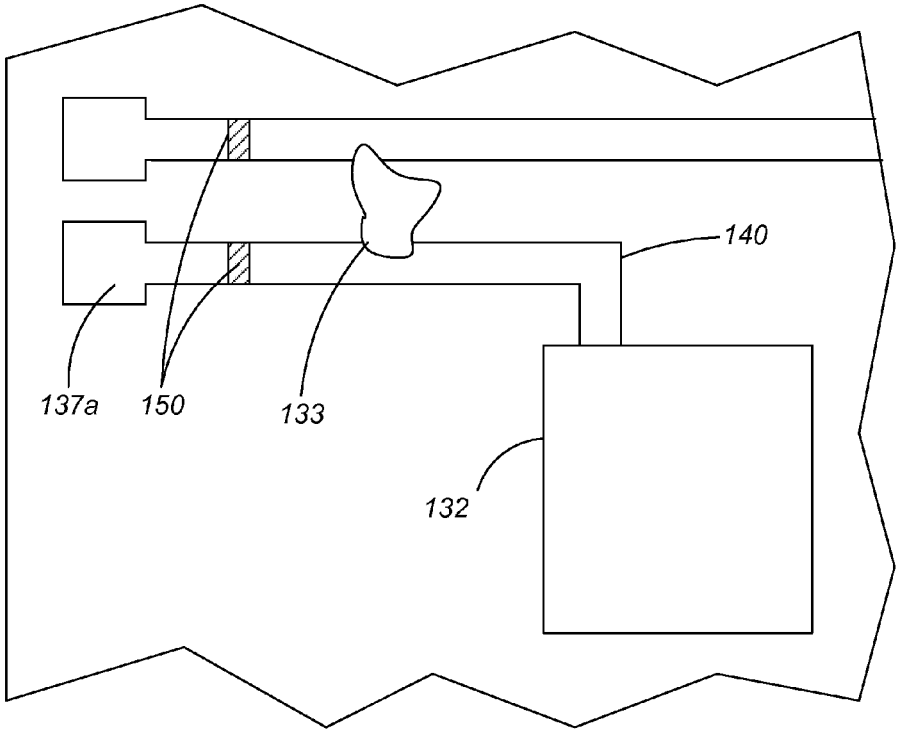
FIGS. 2A-D show plan views of multiple fluid ejector units, each of which has an electrodes 130 connected to a corresponding bond pads 137*a* by a trace 140.

In various implementations, trimming can electrically isolate the shorted fluid ejector units, thereby disabling the shorted fluid ejector unit. For example, similar to FIG. 1E, FIG. 2A shows that trimming 150 can cut all traces between bond pads 137*a* and the electrodes that are shorted together, thereby disabling the shorted fluid ejector units. The cuts can be made through the traces on both sides of the short. In each trace, the cut is made closer to the bond pad 137*a* than the short.

Figure 2B:
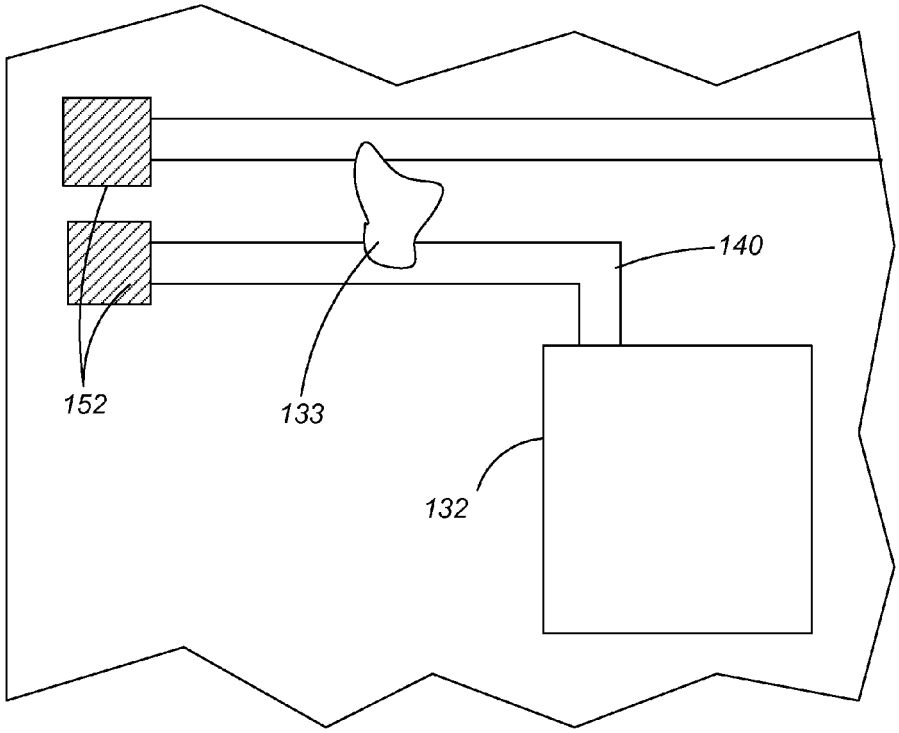

Similar to FIG. 1F, FIG. 2B shows that trimming can also be performed by removing corresponding bond pads 137, thereby disabling the shorted fluid ejector units.

Figure 2C:
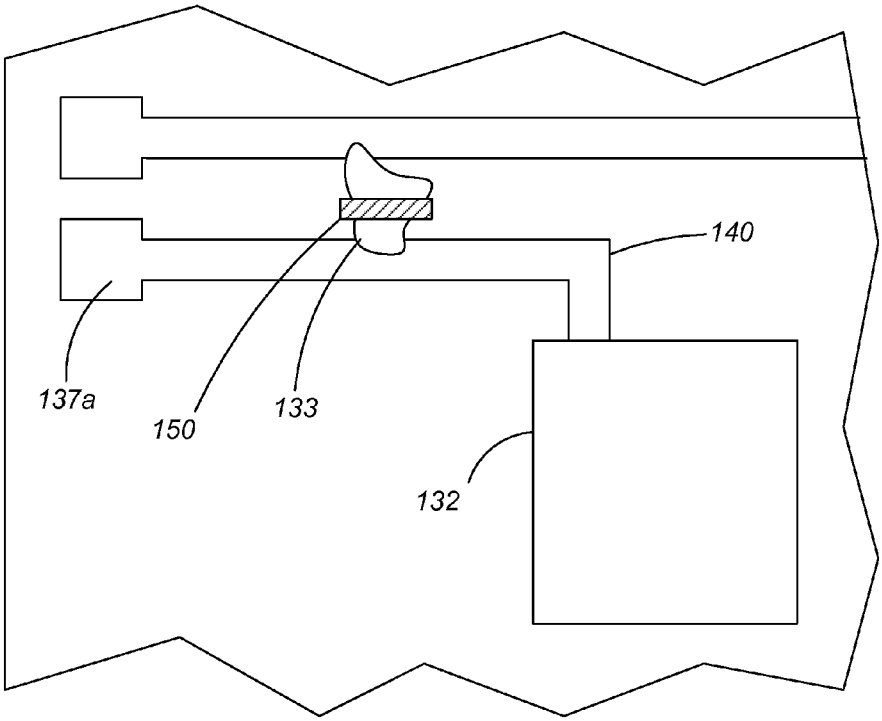

In various implementations, trimming can remove the short itself, so that the shorted fluid ejection module can be restored to function, or at least partial function. FIG. 2C shows that short 133 itself can be trimmed, e.g., the cut is made through the metallization of the short to sever the electrical connection between the adjacent electrodes, which can restore shorted fluid ejector units to partial or complete function.

Figure 2D:
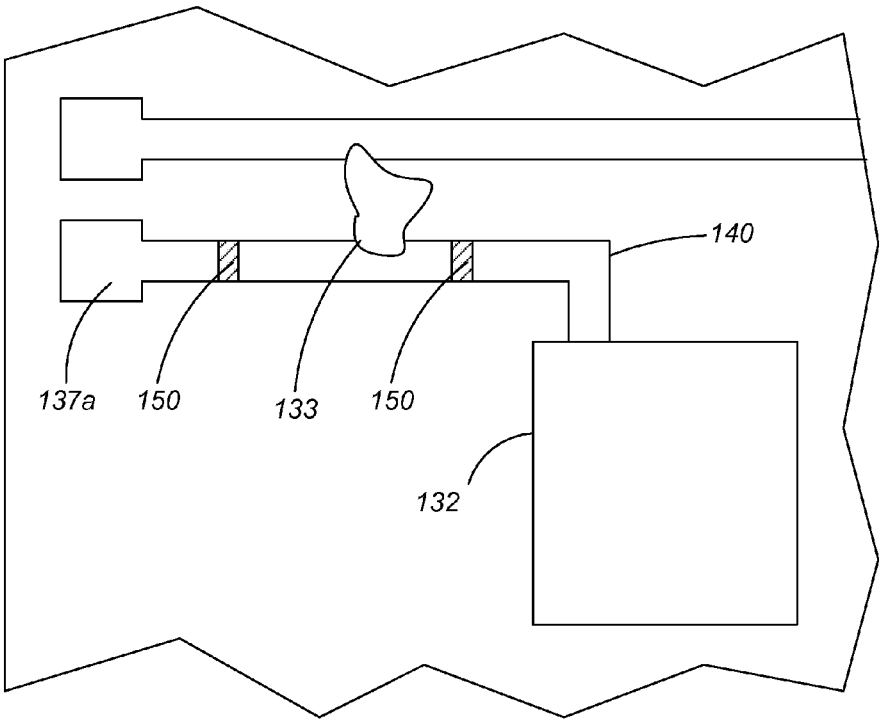

FIG. 2D depicts one method of restoring one of the shorted fluid ejector units to at least partial function. One of the traces contacted by short 133 is severed on both sides, whereas the other trace is not cut. That electrode 140 is disabled, but function should be restored for the other electrode.

The scale, shape, and number of the defects depicted herein, e.g., in FIGS. 1C-H and 2A-D, are provided for illustrative purposes and are not intended to be limiting. A shorted fluid ejection module may have one or more shorts, which may differ in shape and scale from those depicted. Formation of such shorts can include random variations, which can lead to shorts of different shapes, numbers, scale, etc. similar or different to the shorts depicted herein. The trimming steps described herein can be adapted to address such various shorts as may be formed.

By trimming to disable or partially restore shorted fluid ejection modules, defective or problematic fluid ejection modules can be restored or at least disabled, thus decreasing the amount of fluid ejectors which need be discarded due to manufacturing defects. In support of this objective, the method can include recording a location/identity and status of one or more fluid ejection modules, e.g., status such as which modules may be shorted, disabled, partially restored, fully functional, and the like. A fluid ejection printing system can include an electronically readable memory where such recorded information can be stored. A computer program, tangibly embedded in a computer readable medium, e.g., a memory or a disk drive, can employ information recorded about the status of the fluid ejector units to adapt a default jetting procedure to at least partially compensate for modules which may be shorted, disabled, partially restored, and the like. For example, where a fluid ejector unit has been disabled, the ejection of fluid by fluid ejector units adjacent to the disabled unit can be increase, e.g., to cover the region of the print media that would be printed on by the disabled unit and thus avoid streaking in the printed image. As another example, where a fluid ejector unit is partially restored, timing or shape of drive signals to the actuator of the partially restored fluid ejector unit can be adjusted from the default so that fluid drops impact the proper position or emerge with the proper size or velocity.

Figure 3A:
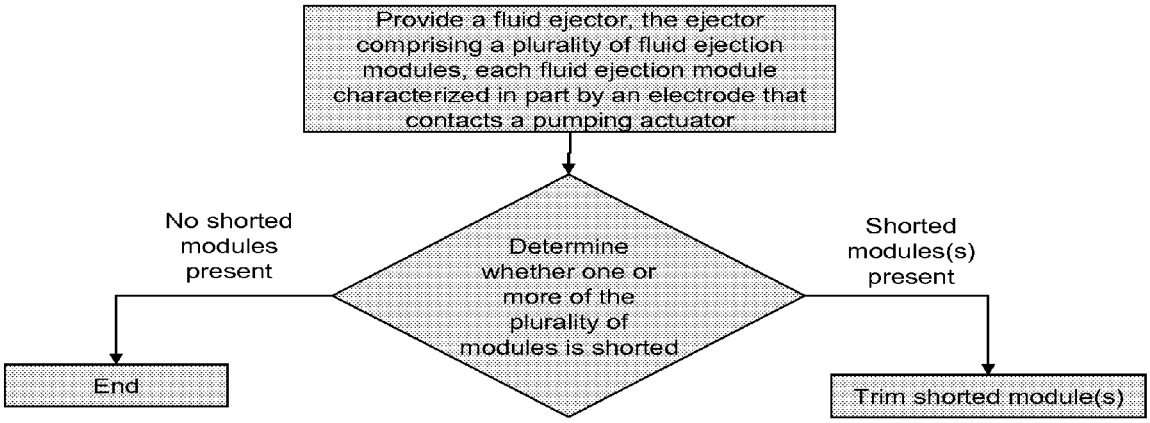
FIGS. 3A-C shows flow charts of various implementations of the method.
Figure 3B:
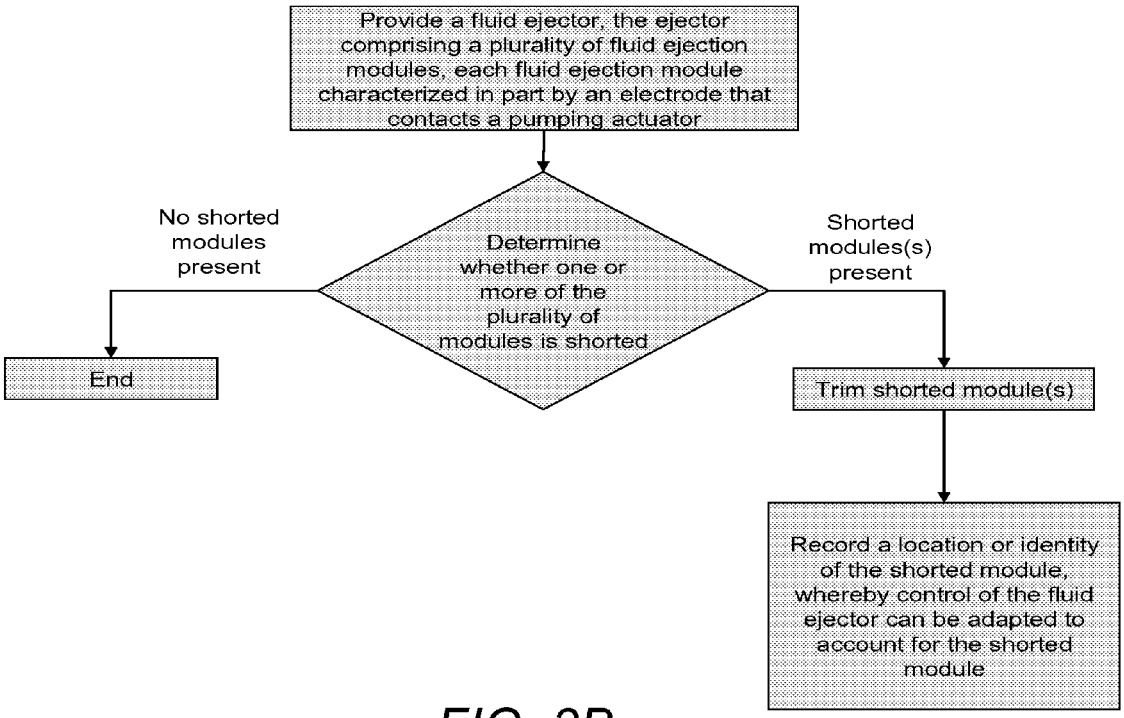
Figure 3C:
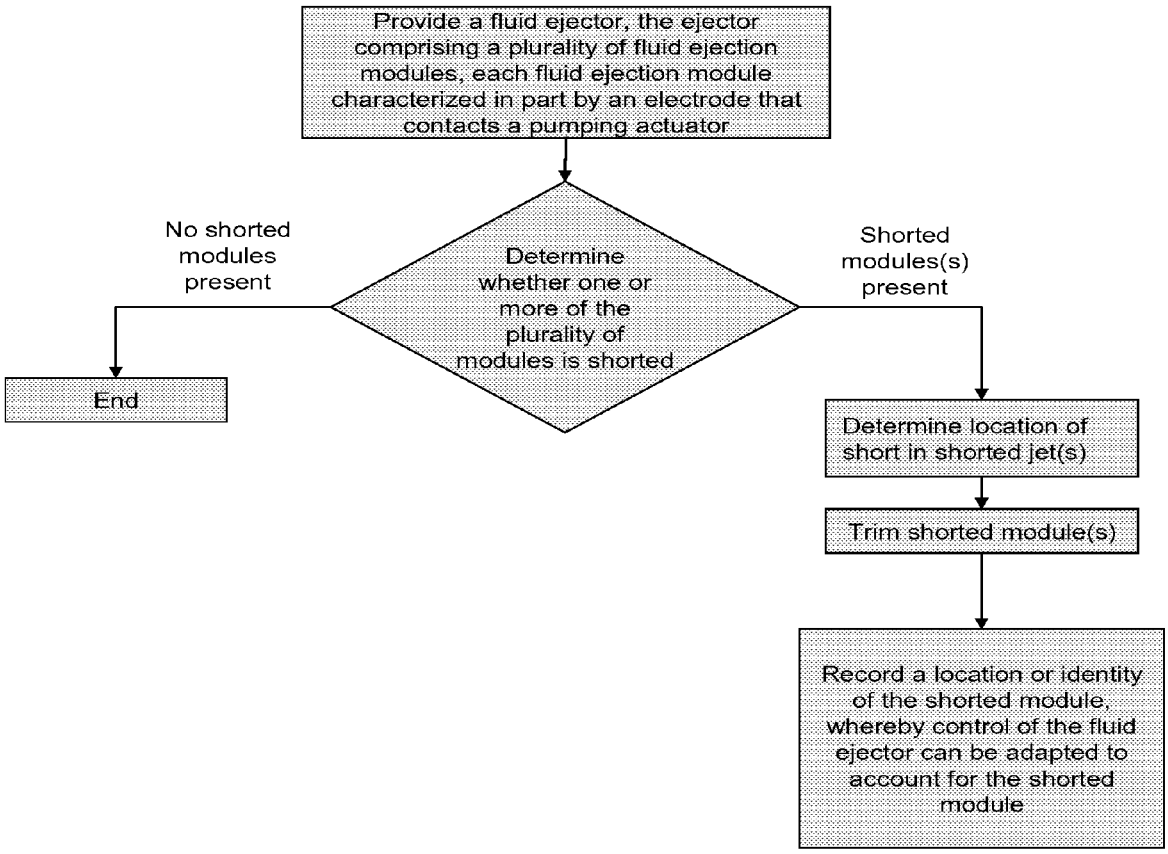

FIGS. 3A-C shows flow charts of various implementations of the method. In FIG. 3A, the method begins with a fluid ejector/printhead (e.g. ejector 34), which includes a plurality of fluid ejector units, each fluid ejector unit characterized in part by an electrode that contacts a pumping actuator. The method continues by determining whether one or more of the plurality of fluid ejector units is a shorted fluid ejector unit. The method also includes a step of trimming the shorted fluid ejector unit. If multiple shorted fluid ejector units are determined, such additional fluid ejector units can also be trimmed.

FIG. 3B shows the method described in FIG. 3A, with the additional step of recording a location or identity of the shorted fluid ejection module, whereby control of the fluid ejector/printhead can be adapted to account for the shorted fluid ejection module. This step, shown subsequent to the trimming step, could also be performed after the determining step but before the trimming step.

In FIG. 3C, the method begins with a fluid ejector/printhead (e.g. fluid ejector of die 34) which includes a plurality of fluid ejection modules, each fluid ejection module characterized in part by an electrode that contacts a pumping actuator. The method continues by determining whether one or more of the plurality of fluid ejection module is a shorted fluid ejection module. Also included is determining the location of a short in the shorted fluid ejection module. These two determining steps are described distinctly, but in some implementations could be combined in a single step, since by determining the location of a short in a shorted fluid ejection module, one has necessarily determined whether one or more of the plurality of fluid ejection modules is a shorted fluid ejection module. In some implementations, the steps can be conducted distinctly, for example, first determining whether one or more of the plurality of fluid ejection modules is a shorted fluid ejection module using capacitance measurement or current leakage measurement, which may be faster or otherwise more convenient for scanning large numbers of fluid ejection modules. When a shorted fluid ejection module is so determined, the step of determining the location of a short in the shorted fluid ejection module can be conducted. The method continues by trimming the shorted fluid ejection module(s). Another, optional step is recording a location or identity of the shorted fluid ejection module and/or each shorted electrode cut by the trimming step, whereby control of the fluid ejector can be adapted to account for the partial restoration of function in the shorted fluid ejection module.

The method can include determining whether one or more of the plurality of fluid ejector units is a shorted fluid ejector unit. The shorted fluid ejector unit(s) can be determined by a capacitance measurement, for example, by operating the circuitry of the fluid ejector and determining a shorted fluid ejector unit according to a capacitance measurement that deviates from that for a functional fluid ejector unit. The capacitance of pumping actuators 26 (e.g., between the electrodes on opposing sides of the piezoelectric layers) can be measured using any convenient technique, for example, a capacitance meter in conjunction with a wafer probe system. The shorted fluid ejector unit(s) can also be determined by a leakage current measurement. Current leakage to ground could be measured for each fluid ejector unit, and fluid ejector units exhibiting leakage above a threshold can be identified as shorted.

The shorted fluid ejector unit can also be determined by observing, imaging, or scanning the electrode or conducting trace which causes the short itself, e.g., a stray conducting trace left over from the lithographic manufacturing process employed to create the circuitry of fluid ejector unit. For example, techniques which may be used to detect the conducting trace which causes the short itself include optical microscopy, thermal imaging during electrical stimulation of the shorted fluid ejection module, electron microscopy, laser scanning, or the like. Also, by observing the conducting trace which causes the short itself, the particular location of the short in the fluid ejection module can be determined. In addition, shorted ejector units can initially be determined by a capacitance or current leakage measurement, and then optically inspected to determine the location and shape of the short The method includes trimming the shorted fluid ejector unit. The trimming can be accomplished using any convenient technique. In various implementations, the trimming can be performed by a laser, by an etch process, by an ion beam, or by mechanical cutting. Trimming cuts entirely through the thickness of the drive electrode 32 or trace 40 until the underlying insulating layer 30 or piezoelectric layer 27 is exposed. Trimming can also cut into or through the insulating layer 30 or piezoelectric layer 27.

Where the trimming is performed by a laser and the drive electrode 32 is formed by metalizing a surface of a piezoelectric layer 27 in the pumping actuator 26, portions of the metalized surface forming the drive electrode 32 can be removed by laser ablation using a laser. In one implementation, a laser device available from Electro Scientific Industries, Inc. (ESI) of Portland, Oreg., is used to trim such electrodes. The component including the electrode formed on the piezoelectric layer is positioned on a stage that can move the component relative to the laser. For example, the stage can be a product from Electroglas, Inc. A processor executing a software application (i.e., a computer program product on a computer readable medium, e.g., memory or a disk drive) can be used to control both the laser device and the stage, to position the component relative to the wafer during the trimming process.

A number of embodiments have been described. Nevertheless, it will be understood that various modifications may be made without departing from the spirit and scope of the disclosure. For example, the steps in the process shown in the right-hand side of each of FIGS. 3B and 3C can be performed in a different order than shown and still achieve desired results. Accordingly, other embodiments may be within the scope of the following claims.

What is claimed is:

1. A method, comprising:

determining that one or more of a plurality of fluid ejector units of a fluid ejector is an electrically shorted fluid ejector unit, each fluid ejector unit characterized in part by an actuator having a piezoelectric layer, an upper electrode overlying the piezoelectric layer, and a lower electrode underlying the piezoelectric layer, and a conductive trace connecting the upper electrode to a bond pad;

determining an electrical short in the electrically shorted fluid ejector to be from the upper electrode through the piezoelectric layer to the lower electrode; and trimming the shorted fluid ejector unit by cutting along a path through the upper electrode to isolate a first portion of the upper electrode containing the electrical short from the conductive trace while leaving a second portion of the upper electrode connected to the conductive trace.

2. The method of claim 1, wherein the shorted fluid ejector unit is determined by a capacitance measurement, optical microscopy, thermal imaging during electrical stimulation of the shorted fluid ejector unit, electron microscopy, or laser scanning.

3. The method of claim 2, wherein the shorted fluid ejector unit is determined by a capacitance measurement.

4. The method of claim 1, further comprising recording a location or identity of the shorted fluid ejector unit, whereby control of the fluid ejector can be adapted to account for trimming of the shorted fluid ejector unit.

5. The method of claim 1, wherein a location of the electrical short in the shorted fluid ejector unit is determined by optical microscopy.

6. The method of claim 1, wherein a location of the electrical short in the shorted fluid ejector unit is determined by thermal imaging during electrical stimulation of the shorted fluid ejector unit via alternating current or direct current.

7. The method of claim 1, wherein trimming restores the shorted fluid ejector unit to function.

8. The method of claim 1, wherein the trimming is performed by a laser, an etch process, by an ion beam, or by mechanical cutting.

9. The method of claim 8, wherein the trimming is performed by a laser.

10. A fluid ejector, comprising:

a plurality of fluid ejector units, each fluid ejector unit characterized in part by an actuator having a piezoelectric layer, an upper electrode overlying the piezoelectric layer, and a lower electrode underlying the piezoelectric layer, and a conductive trace connecting the upper electrode to a bond pad, wherein one or more of the plurality of fluid ejector units is an otherwise shorted fluid ejector unit that is at least partially restored to function, the one or more of the plurality comprising an electrical short from the upper electrode through the piezoelectric layer to the lower electrode and a cut along a path through the upper electrode that isolates a first portion of the upper electrode containing the electrical short from the conductive trace while leaving a second portion of the upper electrode connected to the conductive trace.

11. The fluid ejector of claim 10, further comprising an electronically readable memory, wherein the memory records a location or identity of the one or more of the plurality, whereby control of the fluid ejector can be adapted to account for the shorted fluid ejector unit.

12. The fluid ejector of claim 10, wherein the cut isolates the electrical short in the otherwise shorted fluid ejector unit such that the one or more of the plurality is restored to function.

* * * * *